United States Patent [19]

Anderson

[11] 3,951,779

[45] Apr. 20, 1976

[54] HYDROSEPARATION PROCESS FOR AQUEOUS EXTRACTION OF BITUMEN FROM TAR SANDS

[75] Inventor: Joseph C. Anderson, Fort McMurray, Canada

[73] Assignee: Great Canadian Oil Sands Limited, Toronto, Canada

[22] Filed: Oct. 21, 1974

[21] Appl. No.: 516,222

Related U.S. Application Data

[63] Continuation of Ser. No. 506,672, Sept. 16, 1974, abandoned.

[52] U.S. Cl. ..... 208/11 LE

[51] Int. Cl.[2] ..... C10G 1/04

[58] Field of Search ..... 208/11

[56] References Cited

UNITED STATES PATENTS

| | | | |
|---|---|---|---|
| 3,401,110 | 9/1968 | Floyd et al. | 208/11 |
| 3,487,003 | 12/1969 | Baillie et al. | 208/11 |
| 3,509,037 | 4/1970 | Tse | 208/11 |
| 3,530,042 | 9/1970 | Graybill et al. | 208/11 |
| 3,558,469 | 1/1971 | White et al. | 208/11 |
| 3,607,720 | 9/1971 | Paulson | 208/11 |

*Primary Examiner*—Delbert E. Gantz
*Assistant Examiner*—James W. Hellwege
*Attorney, Agent, or Firm*—Donald R. Johnson; J. Edward Hess; Richard P. Maloney

[57] ABSTRACT

A method for improving recovery in a hot water process for extracting bitumen from tar sands comprising adding bitumen-depleted middlings recovered from a scavenger zone to the sand layer in a primary extraction vessel at a point below the surface of the sand.

6 Claims, 1 Drawing Figure

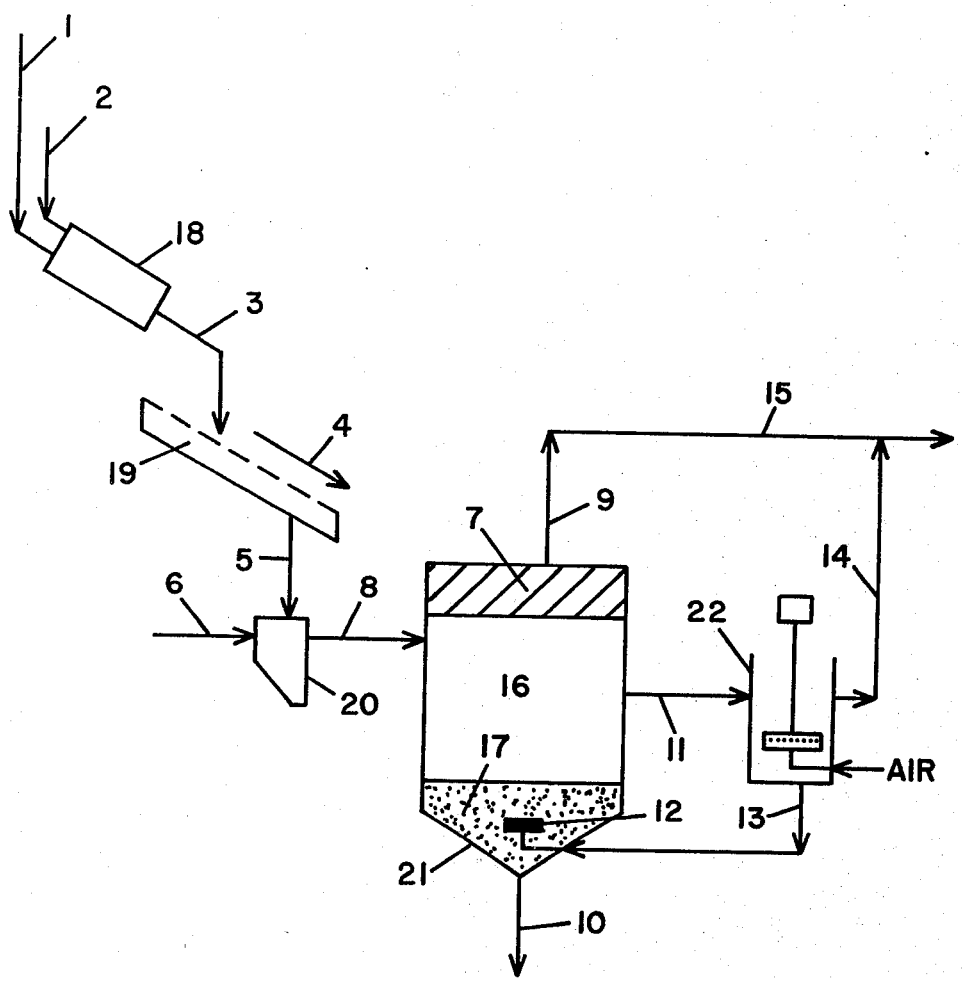
1
2
18
3
4
19
5
6
8
20
7
9
15
14
22
16
11
17
12
13
AIR
21
10

HYDROSEPARATION PROCESS FOR AQUEOUS EXTRACTION OF BITUMEN FROM TAR SANDS

RELATED U.S. APPLICATION DATA

This is a continuation of Ser. No. 506,672 filed Sept. 16, 1974, and now abandoned.

Tar sands which are also known as oil sands and bituminous sands are siliceous materials which are impregnated with a heavy petroleum. The largest and most important deposits of the sands are the Athabasca sands, found in northern Alberta, Canada. These sands underlay more than 13,000 square miles at a depth of 0 to 2000 feet. Total recoverable reserves after extraction and processing are estimated at more than 300 billion barrels.

The tar sands are primarily silica, having closely associated therewith an oil film which varies from about 5 to 21 percent by weight, with a typical content of 13 weight percent of the sand. The oil is quite viscous—6° to 8° API gravity—and contains typically 4.5 percent sulfur and 38 percent aromatics. The sands contain, in addition to the oil and sand components, clay and silt in quantities of from 1 to 50 weight percent, more usually 10 to 30 percent. The sands also contain a small amount of water, in quantities of 1 to 10 percent by weight, in the form of a capsule around the sand grains.

Several basic extraction methods have been known for many years for the separation of oil from the sands. In the so called "cold water" method, the separation is accomplished by mixing the sands with a solvent capable of dissolving the bitumen constituent. The mixture is then introduced into a large volume of water, water with a surface agent added, or a solution of a neutral salt in water, which salt is capable of acting as an electrolyte. The combined mass is then subjected to a pressure or gravity separation.

In the hot water method, as disclosed in Canadian Pat. No. 841,581 issued May 12, 1970 to Floyd et al., the bituminous sands are jetted with steam and mulled with a minor amount of hot water at temperatures of 170° to 190°F., and the resulting pulp is then dropped into a turbulent stream of circulating hot water and carried to a separation cell maintained at a temperature of about 185°F. In the separation cell, sand settles to the bottom as tailings and oil rises to the top in the form of a froth. An aqueous middlings layer comprising clay and silt and some oil is formed between these layers.

The middlings layer contains most of the silt and clay as well as some bitumen, about 3 to 5 weight percent contained in the tar sands. In current practice, a stream of middlings is normally withdrawn from the separation cell and subject to an air scavenging procedure whereby additional bitumen froth is recovered.

The oil froth from the top of the primary extraction cell is recovered as product and can be further processed to a valuable synthetic crude oil. The sand tailings in the bottom of the extraction cell are normally removed through an exit in the bottom of the cell along with a quantity of bitumen-rich middlings contained in the intersticies of the sand layer. Also, middlings material is withdrawn from the cell through the bottom exit and serves to dilute the sand layer so that it may be pumped to the discharge area by normal means. Thus, by the practice of this method, a reasonably large quantity of otherwise recoverable bitumen is discarded from the separation zone along with the sand tailings.

Various aqueous waste streams obtained at various parts of the hot water process are usually pumped to a pond where some of the mineral matter and bitumen settle out to form an upper water layer, an intermediate sludge layer, and a lower heavier layer. Some of this clarified pond water can be reused in the extraction process.

Copending U.S. patent application Ser. No. 516,063 filed of even date herewith discloses an improvement to the above-defined hot water process by Floyd et al. Essentially, the improvement comprises inserting the abovementioned pond water and/or sludge into the cell at a point below the upper surface of the sand tailings layer. By this process the bitumen-rich middlings in the interstices of the sand tailings layer in the bottom of the hot water separation cell are displaced so that in a large part they remain with the cell and are subsequently recovered in the air scavenger zone. This process is generally referred to as hot water hydroseparation. When effectively practiced, hot water hydroseparation substantially reduces the loss of bitumen-rich middlings material through the sand tailings exit in the bottom of the cell and thereby provides a hot water extraction process wherein improved bitumen recovery is achieved. The present invention provides an improvement in the hot water extraction process set forth above.

DESCRIPTION OF THE INVENTION

The present invention relates to a method for reducing the loss of recoverable bitumen from the hot water process for the extraction of bitumen from tar sands. Specifically, the present invention is a method utilizing hydroseparation techniques to improve recovery of bitumen which previously was discarded in waste water streams. More specifically, the present invention is an improvement in the hot water hydroseparation process in which a bitumen-depleted middlings stream recovered from an air scavenger zone is used as hydroseparation fluid to displace bitumen-rich middlings from the interstices of the sand tailings layer in the separation zone of a hot water extraction process. By utilizing the depleted middlings stream from the scavenger zone to replace bitumen-rich middlings in the interstices of the sand tailings layer as well as a carrier for transferring tailings from the primary extraction zone, an improvement in the efficiency of recovery of bitumen from tar sands in the hot water extraction process is achieved.

To more clearly illustrate one mode of the method of the present invention, the following drawing is provided. Referring to the drawing, bituminous tar sands are fed into a hot water conditioning zone 18. Water and steam are introduced from 2 into the conditioning zone and are mixed with the sands. Total water so introduced is a minor amount based on the weight of the tar sands and generally is in the range of 10 to 45 percent by weight of the mixture. Enough steam is introduced to raise the temperature in the conditioning drum to within the range of 130° to 210°F. and preferably above 170°F. and most preferably about 185°F. Water added into the mixing zone can also be a middlings layer drag stream withdrawn from primary extraction zone 21 and transferred to conditioning vessel 18 by means not shown in this drawing.

An alkaline-containing reagent can also be added to the conditioning zone in the amount of about 0.1 to 3.0 pounds per ton of tar sand. The amount of such alkaline reagent preferably is regulated to maintain the pH of the middlings layer in the separation zone 21 within the range of 7.5 to 9.0 with best results being obtained at a pH in the range of 8.0 to 8.5. The quantity of alkaline reagent that needs to be added to maintain the pH in the desired range can vary from time to time as the composition of the tar sands obtained from the mine site varies. Alkaline reagents suitable for use include caustic soda, sodium carbonate, or sodium silicate, although any of the other alkaline-containing reagents known in the art for this application can be used if desired.

The mixture from conditioning zone 18 can be transferred via line 3 to screen 19 wherein oversize matter such as rock and large lumps of tar sand or clay are removed as indicated at 4. The pulp then passes as indicated via line 5 into sump 20 wherein it is diluted with additional water from line 6 which can also contain middlings withdrawn from the extraction zone 21. This middlings recycle would be provided by means not shown in this drawing.

Addition of water to the pulp in sump 20 dilutes the pulp to a pumpable viscosity so that it can be easily transferred into separation zone 21 via line 8 as indicated. Additional water can also be added to screen 19 to wash the pulp through the screen and act as the diluent for the pulp. In normal practice, the total amount of water added to the tar sand pulp as liquid water and steam prior to the separation step should be in the range of 0.2 to 3.0 pounds of water per pound of tar sands being processed. The water requirements for the separation zone, of course, are contingent upon the quantity of silt and clay which the tar sands contain as compared to the bitumen content of the tar sands. These conditions are amply described in the prior art.

In separation zone 21, the content of the separation zone normally separates into an upper bitumen froth layer as indicated by 7, a middlings layer indicated by 16, and a sand tailings layer indicated by 17. The bitumen froth is recovered from separation zone 21 via line 9 and transferred into line 15. A middlings drag stream is withdrawn from separation zone 21 and transferred via line 11 into air scavenger zone 22. Air is added to scavenger zone 22 as indicated on the drawing. Additional bitumen froth is recovered from zone 22 and is transferred via line 14 into line 15 where it is combined with the primary froth from the extraction zone 21 to be further processed into suitable petroleum products. Separation zone 21 is maintained at a temperature in the range of 130° to 210°F. and preferably in the range of 170° to 190°F. with the most preferred temperature being 185°F.

A depleted middlings stream comprised substantially of clay, silt, and water with very little bitumen remaining is withdrawn from scavenger zone 22 and transferred via line 13 to hydroseparator fluid injection means 12 disposed within separation zone 21. By this procedure, the bitumen-rich middlings which normally fill the interstices of the sand tailings layer are displaced by the bitumen-lean scavenger zone tailings.

The effectiveness of this displacement will depend on several factors which are best understood from the discussion which follows.

Injection of depleted middlings into the sand layer creates, in effect, a barrier of depleted middlings in the vicinity of the injection through which middlings will not pass. If this barrier extends over the entire horizontal cross-section of the sand layer, then ideally little or no middlings will be removed with the sand through discharge line 10. In other words, the middlings will be displaced by the depleted middlings and, since no longer removed through line 10, will ultimately be removed and recovered through line 11. In practice it has been found; however, that good results are still obtained even if the barrier extends only over somewhat more than the sand tailings outlet as opposed to the entire sand tailings layer, provided the barrier is close enough to the outlet.

Accordingly, it will be appreciated that for best results the depleted middlings should be injected in a manner which tends to create a barrier in the sand tailings over the sand tailings outlet rather than being injected at one or more randomly selected points. In order to accomplish this, line 12 as shown in the drawing can be a circle of pipe mounted just above sand tailings outlet 10 and having a plurality of outlets distributed about the inner and/or outer perimeters thereof. The depleted middlings are pumped into the pipe and discharged therefrom through each of the outlets to displace middlings from the interstices of the sand. Alternatively, one or more nozzles appropriately positioned may be used to disperse the depleted middlings into the sand layer. As another alternative, a plurality of horizontal pipes with nozzles positioned thereon may be mounted in the sand layer. Some displacement of middlings will occur with almost any depleted middlings distribution means but as mentioned above it is preferably near the sand tailings outlet.

Another factor with a significant effect on the efficiency of middlings displacement is the rate of sand tailings withdrawal through exit 10. The rate of sand withdrawal from the separation zone is regulated to maintain a sand layer between the sand discharge in the bottom of the cell and the middlings layer in the center portion of the cell. This provides a "sand seal" over the bottom exit which prohibits bitumen-rich middlings from flowing directly out of the cell from middlings layer 16. If this seal is not provided, injection of hydroseparation fluid serves merely to dilute the middlings rather than to displace them.

In injecting the depleted middlings into the sand layer, care should be taken to avoid disturbing the upper surface of the tailings layer. In other words, the depleted middlings should remain in the sand layer and should not be injected with such velocity that they travel into middlings layer 16, for this will reduce the effectiveness of the sand seal.

Although the amount of sand in the bottom of the cell is determined primarily by the rate of sand removal, other factors can help in maintaining a sand seal. For example, a conical bottom tank is helpful because of its inherent tendency to keep sand over the sand outlet. Also, a sand rake as disclosed in the aforesaid Floyd et al. patent is sometimes useful in leveling the upper surface of the sand bed.

The attached FIGURE shows the sand bed as having a sharp line of demarcation between it and the middlings layer. One skilled in the art will realize that this is not actually the case, and could not be in a cell operating continuously with one feed and a plurality of discharge streams. The sand layer is better described as a substantially quiescent bed of sand. If fully compacted, the sand bed would be 75 to 80 percent by weight sand. In actual practice, the bed is usually 50 to 70 percent sand but can sometimes be even less than this. The important point for the present purpose is that there be no substantial flow of middlings directly from middlings layer 16 through the sand discharge exit.

The amount of hydroseparation liquid supplied to the cell should be sufficient to adequately dilute the sand tailings for easy transfer from the cell. If necessary, additional liquid can be added directly in line 10. The effluents discharged through line 10 can be discarded to a storage area.

In the method of the present invention, the hydroseparation liquid is middlings which have been subject to a scavenging treatment to essentially remove most of the bitumen therefrom. One advantage achieved by use of scavenged middlings lies in the fact that, other than having a reduced bitumen content, this stream is substantially similar, particularly in mineral content, to the bitumen-rich middlings in the separation cell. Thus, there is no dilution of the middlings as would occur if a lower mineral content hydroseparation fluid was used.

Another advantage of using bitumen depleted middlings stream as the hydroseparation fluid lies in the fact that the temperature of this tailings stream is relatively close to that of the content of the separation zone and, therefore, normally does not require preheating before use. Thus, the present invention is an improved hydroseparation hot water extraction method for recovering bitumen from tar sands comprising adding bitumen-depleted middlings material to the sand layer at a point below the surface thereof in the bottom of a hot water extraction gravity settling zone for recovering bitumen from tar sands. Essentially the present invention provides an improved hot water hydroseparation process for recovering bitumen from tar sands wherein bitumen-depleted middlings material is utilized as hydroseparation fluid to displace bitumen-rich middlings material from the interstices of a sand layer in the bottom of a hot water extraction zone and thereby enhancing the recovery of bitumen from tar sands.

Specifically, the present invention provides that in a hot water process for recovering bitumen from tar sands comprising:

a. forming a mixture of tar sands and water;
b. settling said mixture in a separation zone to form an upper bitumen froth layer, a sand tailings layer, and a middlings layer containing silt, clay, and bitumen;
c. recovering said upper bitumen froth layer;
d. removing sand from a sand discharge outlet in the bottom of the zone at a controlled rate to maintain a substantially quiescent bed of sand in the bottom of the zone which seals the middlings layer from said discharge outlet; and
e. passing at least a part of the middlings from said separation zone to a scavenger zone and therein recovering an additional amount of bituminous froth, the improvement which comprises removing a stream of depleted middlings from the scavenger zone and injecting said stream into and below the surface of the sand bed in the separation zone to displace bitumen-rich middlings from the interstices thereof without disturbing the upper surface of the bed and thereby disturbing said seal.

Other fluids such as pond water recovered from a retention zone used to store discharge streams from the extraction process for recovering bitumen from tar sands can also be used to supplement the bitumen depleted middlings stream as hydroseparation fluid for use as disclosed above.

The invention claimed is:

1. In a hot water process for recovering bitumen from tar sands comprising:

a. forming a mixture of tar sands and water;
b. settling said mixture in a separation zone to form an upper bitumen froth layer, a sand tailings layer, and a middlings layer containing silt, clay, and bitumen;
c. recovering said upper bitumen froth layer;
d. removing sand from a sand discharge outlet in the bottom of the zone at a controlled rate to maintain a substantially quiescent bed of sand in the bottom of the zone which seals the middlings layer from said discharge outlet; and
e. passing at least a part of the middlings from said separation zone to a scavenger zone and therein recovering an additional amount of bituminous froth, the improvement which comprises removing a stream of bitumen depleted middlings from the scavenger zone and injecting said stream into and below the surface of the sand bed in the separation zone to displace bitumen-rich middlings from the interstices thereof without disturbing the upper surface of the bed and thereby disturbing said seal.

2. A method according to claim 1 wherein a second middlings stream is withdrawn from said separation zone and added to the mixture of step (a).

3. A method according to claim 1 wherein the separation zone of step (b) is maintained at a temperature in the range of 130° to 210°F.

4. A method according to claim 2 wherein the separation zone of step (b) is maintained at a temperature in the range of 130° to 210°F.

5. A method according to claim 1 wherein the surface of the sand bed is raked to promote uniform distribution of the sand bed over the bottom of the separation zone.

6. A method according to claim 1 wherein the depleted middlings are injected through a distributor positioned above the sand discharge outlet.

* * * * *